United States Patent [19]

Barlian et al.

[11] Patent Number: 4,600,977

[45] Date of Patent: Jul. 15, 1986

[54] SURVEILLANCE SIGNAL APPARATUS

[75] Inventors: Reinhold Barlian, 6990 Bad Mergentheim; Martin Fischle, Bad Mergentheim; Karl-Heinz Lux, Weikersheim, all of Fed. Rep. of Germany

[73] Assignee: Reinhold Barlian, Bad Mergentheim, Fed. Rep. of Germany

[21] Appl. No.: 650,384

[22] Filed: Sep. 13, 1984

[30] Foreign Application Priority Data

Sep. 14, 1983 [DE] Fed. Rep. of Germany ..... 3333135

[51] Int. Cl.[4] ..... F21V 29/00

[52] U.S. Cl. ..... 362/362; 362/204; 362/267; 362/294

[58] Field of Search ..... 362/362, 448, 203, 204, 362/267, 307, 288, 289, 294

[56] References Cited

U.S. PATENT DOCUMENTS 4,388,681 6/1983 Meyer ..... 362/267
4,435,744 3/1984 Russo ..... 362/267
4,466,050 8/1984 Lockard ..... 362/307

FOREIGN PATENT DOCUMENTS 2715201 10/1977 Fed. Rep. of Germany ..... 362/362

*Primary Examiner*—Magdalen Y. C. Moy
*Attorney, Agent, or Firm*—Horst M. Kasper

[57] ABSTRACT

The surveillance signal apparatus is preferably provided a signal lamp, as an illuminated switch or as an illuminated key. It comprises a casing with electrical and electronic connections and with an apparatus heat disengageably disposed at the casing. The apparatus head comprises a signal part provided with electric voltage and preferably an illuminating element. A voltage limiter and a current limiter are disposed in an explosion-proof and pressure tight encapsulated space of the casing and they are electrically predisposed to the signal part in the apparatus head via a feed part. The apparatus head with the signal part and the feed part are formed by the output of the voltage limiter and by the output of the current limiter as an explosion protection self safety unit.

19 Claims, 3 Drawing Figures

SURVEILLANCE SIGNAL APPARATUS

BACKGROUND OF THE INVENTION

1. Field of the Invention

The present invention relates to a surveillance signal apparatus, particularly a signal lamp, a signal key, a signal switch or the like with a case having electrical terminals and with an apparatus head disengagebly attached to a the casing, where the apparatus head contains signal part supplied with electrical power.

2. Brief Description of the Background of the Invention Including Prior Art

It is a disadvantage with known surveillance signal apparatus of this kind that in use in spaces which are in danger of explosions or the like corresponding pressure sustaining encapsulations are also to be provided for the apparatus head. The mounting at the front plate of a switching cabinet or other provisions can only be performed with special tools in order to prevent an unintended disengagement in the endangered space area.

SUMMARY OF THE INVENTION

1. Purposes of the Invention

It is an object of the present invention to provide a surveillance signal apparatus which can be employed as a signal lamp, a signal key, a signal switch or the like and which has electric terminals on its casing, which has an apparatus head with a simpler construction and with a high degree of safety against the danger of explosion.

It is another object of the invention to provide an apparatus head for a surveillance signal apparatus, which can be mounted at any time in the explosion endangered space area without special tools and which further can be demounted and/or, be exchanged.

It is a further object of the invention to provide a surveillance signal apparatus where the apparatus head itself is of explosion proof construction.

These and other objects and advantages of the present invention will become evident from the description which follows.

2. Brief Description of the Invention

The present invention provides a surveillance apparatus which comprises electronic terminal connectors, a casing providing an explosion-proof space having attached the electronic terminal connectors, an apparatus head disengageable attached to the casing, a voltage limiter and a current limiter disposed in the casing, a signalling part disposed in the apparatus head and supplied with electrical power from the terminals of the apparatus head, where the voltage limiter and the current limiter are electrically predisposed to the signalling part via the feed part and where the apparatus head with the signalling part and the feed part from the output of the voltage limiter and of the current limiter are provided as an explosion-proof self-safety unit.

A Zener diode can be disposed in the explosion-proof encapsulated space of the casing, electrically predisposed to the signal part and operating as a voltage limiter, and an electrical resistance can be disposed in the explosion-proof encapsulated space of the casing, electrically predisposed to the signal part and operating as an electronic current limiter. A rectifier 51 can be electrically predisposed to the signalling part and disposed in the explosion-proof encapsulated space of the casing, a transformer electrically predisposed to the voltage limiter and to the current limiter and disposed in the explosion-proof encapsulated space of the casing. Further, a printed circuit board can be disposed in the explosion-proof encapsulated space of the casing. An electrical fuse can be disposed on the printed circuit board. Connections can be provided between the feed part of the explosion-proof self safety unit and the printed circuit board board in the explosion-proof space of the casing.

A cast resin can surround the explosion-proof space of the casing containing at least the voltage limiter and the current limiter and wherein the voltage limiter, and the current limiter and the transformer can be embedded into the cast resin and are surrounded by an elastic wall region of the cast resin.

Conductor terminals with conductor parts can be enclosed in the cast resin and disposed in the casing. An electrical conduit with at least one wire disposed at the bottom side of the casing and enclosed in cast resin. A tube socket can be provided for the feed part of the explosion-proof self safety unit in the casing, which surrounds electrical contact springs, and a contact bolt can protrude from the apparatus head containing the signalling part to be supported in the tube socket.

A front flange can be furnished at the tube socket of the feed part contacting an inner face of the case above the explosion-proof encapsulated space. A closure cap cover can block the tube socket at the front face disposed toward the explosion-proof encapsulated space of the building, and a recess can be disposed at the closure cap cover of the tube socket for receiving a front end of the contact bolt.

Contact connections of the contact springs can be led into the region of the cast resin at the front side of the tube socket in the region of the closure cover cap, where the contact springs are inclined directed inwardly in the direction of the closure cover starting from the inner face of the tube socket of the feed part. Base webs of the contact springs of the feed part can be overlapped by wall parts of the tube socket and where an entering inclination is provided in the end region of the tube socket toward the apparatus head.

A compression spring can act in longitudinal direction of the tube socket, where the tube socket of the feed part is in the area of the compression spring, where one end of the compression spring is supported at the end of the casing and where the other end of the compression spring is supported at a pressure piece, which is supported guided at the casing and against the force of the compression spring.

An explosion-proof encapsulated chamber can be disposed in the casing. A microswitch preferably is disposed in the explosion-proof encapsulated chamber next to the explosion-proof encapsulated space with the voltage limiter and the current limiter, which can be actuated via the pressure piece. A lift balancing part can be disposed between the pressure piece and the microswitch, which is provided with a pot bolt with a balancing spring matchingly disposed inside the pot bolt. A ram pin can be disposed between a base wall of the pot bolt and the microswitch in the chamber of the casing, which ram pin in axially movable in an explosion-proof slot feed-through in the wall the casing. A catch provision can be coordinated to the pressure piece with two switch arresting positions. A support frame of about hood shape can be furnished for the casing, which support frame overlaps the pressure piece and the lift balancing part and the catch provision.

An axial conductor of the contact bolt of the feed part can be disposed in an insulating shell and at which one contact spring of the tube socket is disposed. An outer shell conductor can be disposed at the insulating shell at which another contact spring rests. A lamp case can contain the contact bolt of the apparatus head with the collar. Connecting conductors can be led from the collar and from the axial conductor to the signal part formed as an illuminating element.

A reflector can have the illuminating element and both can be disposed in the illuminating case and embedded in a light permeable cast part. A colored lens can cover the illuminating element of the apparatus head. A translucent cover hood can be mounted to the apparatus head over the illuminating element and the lens.

A ceramic carrier can have bonded the light-emitting diode chip as a CERLED. A support plate and at least two electronic illuminating parts can form a CERLED illuminating unit. An insertion body can be screwed tightly with an attachment nut disposed at a threaded part at the inside of a wall. A shell like front ring can surround the lens, which is on the outside screwed onto a thread of the insertion body running through a hole through the wall of a switch cabinet.

A pressure key can be provided at the apparatus head with the illuminating element as an explosion protected switch illumination unit where the outer lens of the illuminating element is disposed in the pressure key repositionable axially in the apparatus head against the casing. A rotary shell can be coordinated to the pressure key and axially movable against the force of a helical spring in the insertion body, which rotary shell acts against the pressure piece surrounding the tube socket.

The features which are considered as novel for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

Several of the various possible embodiments of the present invention are shown in the accompanying drawing.

DESCRIPTION OF INVENTION AND PREFERRED EMBODIMENT

Figure 1:
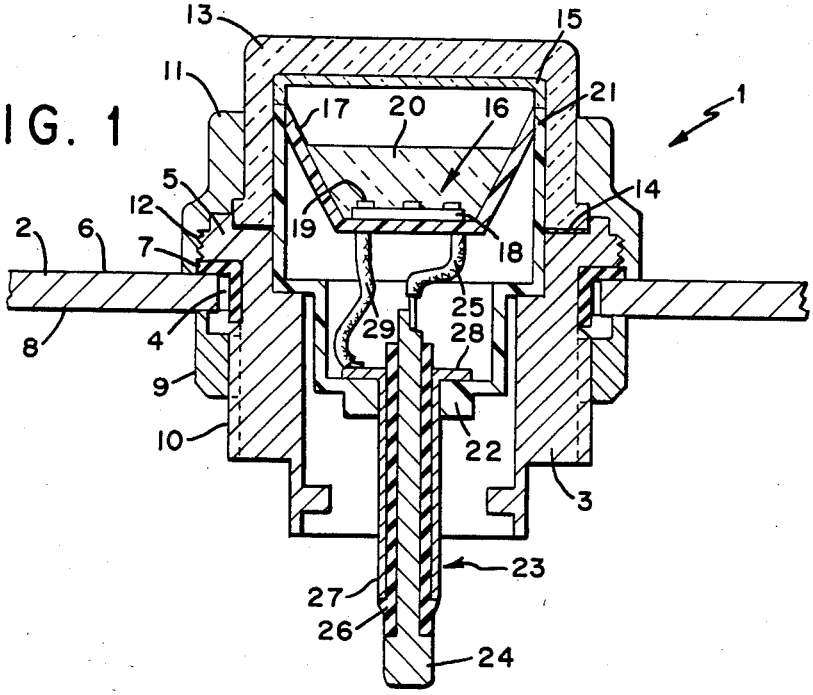
FIG. 1 is a sectional side view of an apparatus head in accordance with the present invention.

In accordance with the present invention there is provided a surveillance signal apparatus 33, which in particular can be a signal lamp, an illuminated key, an illuminated switch, or the like, where a casing is provided having electrical terminals and where the signaling part 16 containing apparatus head is disengageably attached to the casing. The signal part is supplied with electrical power. The voltage limiter and current limiter are disposed in an explosion proof encapsulated space of the casing 30,30' and where a predisposed wire feed part 33 to the signaling part 16 in the apparatus head 1,1'. The apparatus head 1,1' is formed as an explosion proof self safety unit 49 with the signaling part 16, the feed part 33 from the output of the voltage limiter and of the current limiter.

At least a Zener diode is electrically predisposed as voltage limiter and an electrical resistor is predisposed as an electronic current limiter to the signal part in the apparatus head and both the Zener diode and the electrical resistor are disposed in the explosion proof space 48 of the casing 30,30'. The voltage limiter and the current limiter, as well as the signal part 16 can have electrically predisposed rectifier 51 and a transformer 50 electrically predisposed to the voltage limiter and the current limiter. An electronic fuse 52 can be disposed on a printed circuit board 43 in the explosion proof space 48 of the case 30,30'. Connections 42,42' can be disposed between the feed part 33 of the explosion proof self safety unit 49 and the printed circuit board 43 in the explosion proof space 48 of the casing 30,30'.

At least the explosion proof space 48 of the casing 30,30' containing the voltage limiter and the current limiter can be surrounded by cast resin. The parts embedded and surrounded by the cast resin 53 such as the voltage limiter, the current limiter, the transformer 50 are preferably surrounded by an elastic wall region of the cast resin 53. The elastic wall region can have a hardness or, respectively, an elasticity of about 30 to 80 Shore A and can be formed of foam for example.

The case 30,30' can be provided next to explosion proof space containing the voltage limiter and the current limiter and can contain a conductor terminal with conductor parts enclosed in cast resin 53. An electrical conduit 65 with at least one individual conductor 66 can be disposed at the lower side of the casing 30,30' and running into the casing which can be enclosed in cast resin 53.

The feed part 33 of the explosion proof self safety unit 49 can be furnished with tube socket 32 disposed at the casing 30,30'. Electrical contact springs 40,40' can be disposed in the tube socket and a contact bolt 23 of the apparatus head 1,1' containing the signal part 16 can be disposed in the tube socket 32.

Front flange 35 of the tube socket 32 of the feed part 33 can rest at an inner wall of the casing 30,30' via the explosion proof space 48. The tube socket 32 can be blocked at the front face directed toward the explosion proof space 48 of the casing via closure cover cap 36 and the closure cover cap 36 of the tube socket can be provided with recess 37 for receiving front end of contact bolt 23. Contactor connections 41,41' of contact springs 40,40' can be lead into the region of the cast resin 53 at the front side of the tube socket in the region of the closure cap 36. The contact springs 40,40' can be directed inwardly at an inclination starting from the inner face of the tube socket 32 of the feed part 33 in the direction to the closure cap 36.

Base webs 38,38' of the contact springs 40,40' of the feed part 33 can be overlapped by wall parts 39 of the tube socket 32. The end region of the tube socket 32 can be formed with an insertion inclination 34 at the end region disposed toward the apparatus head 1,1'.

The tube socket 32 of the feed part 33 can be disposed in the operating range of compression spring actuating in the longitudinal direction of the tube socket. One end of the tube socket can be supported at the casing and the other end can be supported at a pressure piece 44, which pressure piece is supported against the force of the compression spring 45 in the direction against the casing, 30,30 along this casing.

At least one microswitch 63 switchable via the compression piece 44 can be disposed next to the voltage limiter and the current limiter containing explosion proof space 48 in an explosion proof encapsulated chamber 62 of the casing 30,30'. Lift balancing part 55 can be disposed between the pressure piece 44 and the microswitch 63 which is provided with a pot bolt 56 having a balancing spring matchingly disposed inside. Ram pin 59 can be disposed between a base wall 58 of the pot bolt 56 and the microswitch 63 in the chamber 62 of the casing 30,30' which ram pin can be guided in an explosion proof slot feedthrough 60 in the wall 61 of the casing 30,30' allowing axial shifting. A catch provision 54 with two switch rest positions can be coordinated to the pressure piece 44. An about hood like support frame 46 can be provided at the casing 30,30' and the support frame can reach over the compression spring 45 as well as the lift balancing part 55 and the catch engagement provision 54.

The contact bolt 23 of the feed part 33 can be provided with an axial conductor 24 disposed in an insulating shell. The contact spring 40 of the tube socket 32 can rest at the axial conductor 24. The other contact spring 40' can rest against an outer shell conductor 27 on the insulating shell 26. The contact bolt 23 of the apparatus head 1,1' can be disposed with collar 28 in lamp casing 21. The connecting conductor 25,29 of the collar 28 and the axial conductor 24 can be lead to the signal part front as an illuminating element 16. The illuminating element 16 can be disposed in a reflector 17 of the lamp casing 21 and can be embedded in the light transmitting cast part 20.

The light element 16 of the apparatus head 1.1' can be covered preferably by a color such as red or green lens 15,15' and the apparatus head preferably can be provided with a light transmitting covering hood 13 over the illuminating element 16. The illuminating element 16 in the apparatus head 1,1' can be formed with a ceramic carrier and with bonded light emitting diode-chip as CERLED 19 and can be formed with a carrier plate 18 and at least two, and preferably about five to twenty opto-electronic illuminating parts as CERLED-illuminating unit.

The apparatus head 1,1' containing the signal part 16 can be provided with shell-like front ring 11 surrounding the lens 15,15'. The front ring can be screwed on to a winding 12 passing through a wall 2 of a switching cabinet or the like in a hole 4, passing through the body 3 to be employed, which body is attached with an attachment nut 9, to the inside 8 of the wall 2 supported at the thread part.

The apparatus head 1' with the illuminating element 16 and pressure switch 70 can be formed as an explosion proof switching illuminating unit. The outer lens 15' of the illuminating elements 16 can be disposed in a relocatable pressure key 70. The pressure shell 71 can be coordinated to the relocatable pressure switch 70. An axially shiftable pressure switch 70 can be disposed in the apparatus head 1'. The outer lens 15 of the illuminating element 16 can be disposed in the pressure switch shiftable in the apparatus head in axial direction. An axially shiftable pressure shell 71 can be coordinated to the relocatable pressure switch in the body 3 against the force of a helical spring 72, which pressure shell acts against the pressure piece surrounding the tube socket 32.

Referring now to FIG. 1 there is shown an apparatus head 1 at the front wall 2 of a switch cabinet or the like and disengageably attached without any special tools. The apparatus head 1 is furnished with an insertion body 3, which passes through a hole 4 in the wall 2. The insertion body is provided with a shoulder 5, which is supported at the outside 6 of the wall 2 with the interposition of a rubber elastic seal 7. An attachment nut 9 is screwed against the inside 8 of the wall 2, which rests on a thread part 10 of the insertion body 3. In addition the apparatus head 1 is provided with a front ring 11 on the outside, which is screwably disposed at a thread 12 in the direction against the outside 6 of the wall 2, where the thread is formed at a shoulder 5 of the insertion body. The apparatus head 1 overlaps a translucent covering hood 13 at its circumference and fixes the position versus the insertion body 3 under interposition of an elastic sealing disk 14. The translucent covering hood 13 covers a lens 15, which is preferably colored in the colors red, green, blue, yellow or the like. The lens in turn covers a signal part provided here as an illuminating element 16.

The illuminating element 16 is disposed in the area of a reflector 17, which in the instant case comprises preferably plastic and the reflector face of which is white. It can also be advantageous to provide the reflector 17 with a metallic reflection layer, which for example can be produced by metallization in a high vacuum (metal evaporation). The illuminating element 16 is shown here particularly advantageous as an opto-electronic CERLED illuminating element, where at least two, but preferably about 5 to 20 and more preferably six to eight CERLED components 19 are disposed on a carrier plate 18, where it is also within the scope of the invention to provide a lower number, for example three or four, on the carrier plate or also more, for example 15 CERLED parts 19 at the carrier plate. The CERLED parts comprise substantially a small ceramic carrier, which is disposed on a LED-chip. Advantageously, the ceramic carrier of the CERLED component 19 is provided with a conducting covering on four sides (surface, lower side and the two front faces). The ceramic carrier can have dimensions of for example from 3.2 times 1.27 times 0.6 millimeter and the LED chip can be bonded to the top. A clear plastic lens of about 6 millimeter height is disposed above the LED chip, which protects the LED-chip on the upside of the ceramic carrier in general. This component or, respectively, the CERLED component 19 can be attached with a conducting bottom face and/or with conducting front faces on the carrier plate 18 to corresponding conductor paths. It is also possible to place individual illuminating parts directly on a larger ceramic conductor plate such that thereby a CERLED illuminating unit is formed. The illuminating element 16 can also be provided with one or several glow discharge tubes, neon indicator tubes, incandescent lamps, heated wires, illuminating diodes or the like. The complete illuminating element 16 is embedded into the reflector 17 in a cast part 20, which allows light to pass such that the light irradiated by the illuminating element 16 can radiate to the outside via the cast part 20, the lens 15 and the covering hood 13.

The reflector 17 belongs to a lamp case 21, the base wall 22 is passed by a contact bolt 23, which protrudes at the bottom from the insertion body 3. The contact bolt 23 has an inner axial conductor 24, of which a connecting conductor is 25 is led to the illuminating element 16. The axial conductor is disposed in a tubular insulating shell 26, which is formed somewhat shorter than the the axial conductor 24, such that an upper connection end for the connecting conductor 25 and a lower contact part protrude at the opposite front faces of the insulating shell 26. The insulating shell 26 is again surrounded with a metallic shell conductor 27, which is slightly shorter than the insulating shell 26, such that the latter protrudes from the shell conductor 27 at the two front faces. The shell conductor 27 is provided with a collar 28, which rests in the lamp case 21 at the inner face of the base wall 22. A further connecting conductor 29 is connected to the collar 28 preferably with a solder connection and the connecting conductor 29 is also led to the illuminating element 16.

Figure 2:
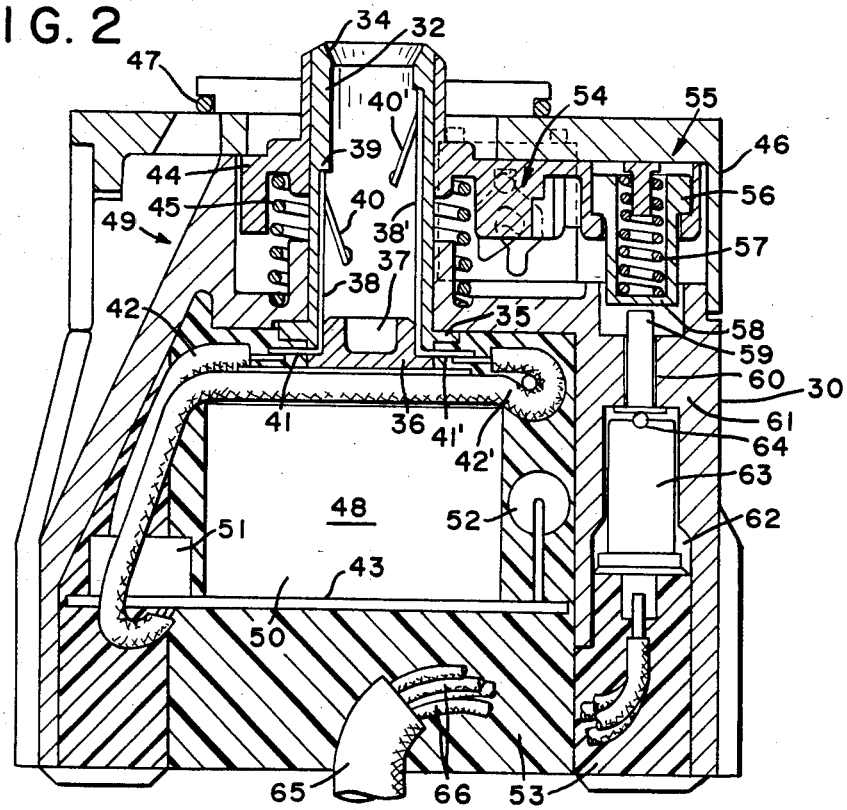
FIG. 2 is a sectional side view of a case for an apparatus head similar to that of FIG. 1.
Figure 3:
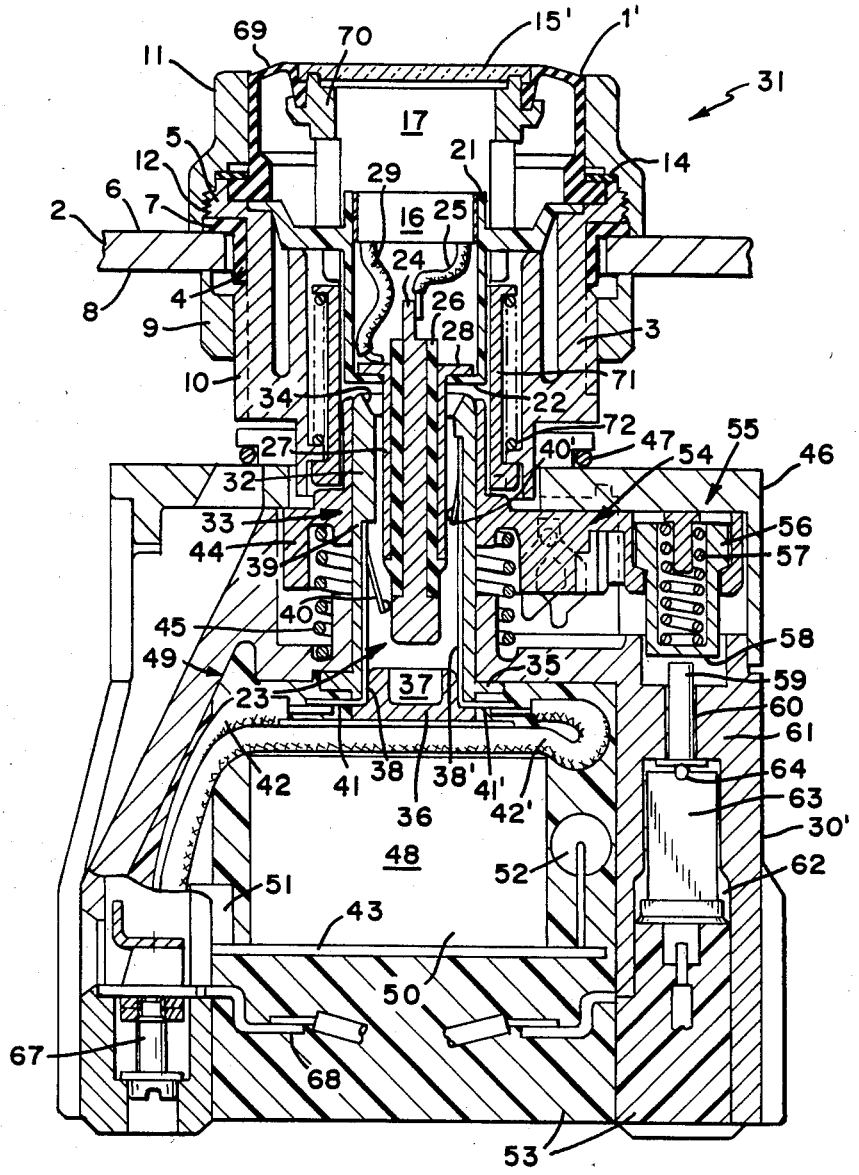
FIG. 3 is a sectional side view of a surveillance apparatus where the apparatus head is coupled to the casing.

A case 30 belongs to the apparatus head 1, as is illustrated substantially in FIGS. 2 and 3. The apparatus head 1 is here disengageably attached at the casing 30 or, respectively, disengageably coupled to the casing 30, such that in case of a coupling a complete surveillance signal apparatus is provided. The contact bolt 23 of the apparatus head 1 is disposed in a tube socket 32 of the case 30. The tube socket 32 and the contact bolt 23 inserted into the same form together a feed part 33 for the feeding of the voltage to the signal part or, respectively, the illuminating element 16.

The tube socket 32 is provided at the free inner wall region disposed toward the apparatus head 1 with an insertion inclination 34 for the contact bolt 23. A front flange 35 is formed at the other end of the tube socket, which is supported at an inner surface of the case 30. In addition, a closure cover cap 36 is disposed in the region of the front flange 35, which closes the tube socket 32 at its lower end region. The closure cover cap 36 is provided with a recess 37 at its side disposed toward the inner space of the tube socket 32, into which the free front face of the contact bolt 23 protruding from the apparatus head or, respectively of the axial conductor 24, can penetrate.

Two electrically conducting base webs 38, 38' are disposed at the inner face of the tube socket 32, which are disposed diametrically opposite to each other and which extend in longitudinal direction of the tube socket 32.

The base webs 38, 38' are overlapped by inwardly protruding wall parts 39 of the tube socket 32 at their free ends directed to the apparatus head 1, whereby a firm support of the base webs 38, 38' is assured in the tube socket 32. The base web is formed somewhat shorter than the opposite base web 38'. A contact spring 40 formed of a same uniform material is disposed at the base web 38, while another contact spring 40' is formed at the base web 38'. The contact springs 40, 40' are directed inwardly inclined in the direction of the middle of the axis and to the closure cover plate 36 of the tube socket 32, such that the contact bolt 23 of the apparatus head 1 can be inserted without interference into the tube socket 32 and a permanent bending of the contact springs 40, 40' is avoided. The contact springs 40, 40' have corresponding contact caps, where the contact cap of the other contact cap 40' rests against the outer surface of the shell conductor 27. The conductor connections 41, 41' are formed at the base webs 38, 38'. The conductor connections 41, 41' are led outwardly according to the present example in the region of the closure cover cap 36 at right angles in opposite directions out of the tube socket 32. The connections 42, 42' are connected to the conductor connections 41, 41', which lead to an electronic printed circuit board 43.

The tube socket 32 is surrounded at its outer circumference by a pressure piece 44, which is guided axially shiftable at the tube socket 32 in its longitudinal direction. The pressure piece 44 is spring loaded by supporting a helical compression spring 45, which also surrounds the tube socket 32, with its one end at the casing 30 and engaging with its other end an annular groove of the pressure piece 44 and presses the latter upwardly in the direction of the apparatus head 1. The case 30 is provided at the top with a hood shaped support frame 46, which is connected to the casing 30 with a releasable catch or, respectively, clip arresting provision. A spring bow 47 is provided at the side of the support frame disposed toward the apparatus head 1 and the spring bow 47 effects a releasable coupling between the apparatus head 1 and the casing 30.

An explosion protected pressure safe room 48 is disposed at about the middle region of the casing 30 under the tube socket 32. At least a voltage limiter and a current limiter not recognizable in the drawing are disposed in this pressure tight space. This limits the voltage fed to the illuminating element 16 in the apparatus head 1 corresponding to the explosion protection self safety (EN 50020) to a maximum of 18 Volts and the highest allowable flowing current is limited to 30 milliamps. Thus a high safety against explosion is provided with simple means without that the apparatus head 1 is subjected to a particular encapsulation and special attachment, but that instead it can be separated from the case at each time without any danger and without the requirement that the voltage has to be cut off and that other safety measures have to be undertaken. The apparatus head 1 is formed with the signal part 16 and the feed part 33 starting from the outputs of the predisposed voltage and current limiters is formed in the pressure stable space 48 according to the invention as an explosion-proof self safety unit 49.

The voltage limiter in the pressure stable room 48 of the casing 30 can advantageously be formed of two Zener diodes connected in parallel, while the current limiter can consist of a correspondingly dimensioned resistor. However, instead of the resistor also an electronic limiter of the current can be employed.

The voltage limiter and the current limiter are advantageously disposed on the electronic circuit board 43 in the pressure stable space 48. A transformer 50 can in addition be disposed in the pressure tight space 48 on the electronic circuit board, which transforms down for example a higher voltage fed to the signal apparatus 31 to an operating voltage fed to the signal part 16. For this purpose a rectifier 51 can be disposed on the printed circuit board 43, via which the alternating current introduced is rectified for operation of the illuminating element 16. In addition, it can be advantageous to provide on the electronic printed circuit board 43 an electric fuse, which is preferably provided as a safety fuse.

The described parts including the voltage limiter, the current limiter, the electronic printed circuit board 43, the transformer 50, the rectifier 51, the electrical fuse 52 and the connections 42, 42' are surrounded by a cast resin for providing a pressure tight encapsulation of the described parts such that a tight cast closure against a danger of explosion is provided. Advantageously, an epoxide resin or also a polyurethane can be provided as a cast resin. In addition, it can be advantageous to adjust the cast resin 53 or to select such various embodiments so that the parts 48 resting in the pressure tight room such as voltage limiter, current limiter, printed circuit boards, conductor plate 43, transformer 50, rectifier 51 and electric fuse 52 are surrounded immediately by an elastic yielding wall region of the cast resin 53 or the like. Then following to this elastic wall region follows the proper solid cast resin part. A high use capability is achieved by the elastic wall region even in case of extreme loads such as for example in the case of vibrations or in case of varying temperature intervals such that at any rate a high permanent functional capability is provided.

A catch provision 54 is disposed on the right next to the tube socket 32 above the pressure stable room 48 according to the present embodiment. The catch provision 54 has two switch arrest positions for a switching lever actuated with a corresponding linkage system. The catch provision 54 is coordinated to the pressure piece 44 and is actuated by the same. In addition, a lift balancing part 55 is actuated via the pressure piece 44. The lift balancing part 55 is provided with a pot bolt 56, wherein a helical balancing spring 57 is placed. The lift balancing part 55 is covered on the top by a support frame 46. A pin ram 59 is disposed under the base wall 58 of the pot bolt 56. The pin ram 59 axially shiftable passes the wall 61 through a cylindrical explosion proof slot feed through and protrudes into an explosion-proof pressure resistant chamber 62. This chamber 62 is disposed according to the embodiment shown to the right hand side next to the pressure resistant space 48 or, respectively, next to the electric fuse 52. A microswitch 63 is disposed in the pressure resistant chamber 62 and the ram pin 59 impinges against the switching pin 64 of the microswitch. It can be advantageous for certain switching functions to dispose two microswitches in the chamber 62. The pressure resistant chamber 62 is as well as the pressure resistant space 48 cast explosion proof with a cast resin 53.

According to the embodiment shown in FIG. 2, the end of the tube conduit 65 is cast into the cast resin 53 in the area under the pressure resistant space 48. The tube conduit 65 comprises individual conduits 66, which belong to corresponding electrical function parts in the case 30. In addition, the possibility exists to cast into the casing 30 at the bottom only one or several individual conduits, which are not combined to a hose line. It is in fact in principle possible to couple the casing 30 illustrated in FIG. 2 with the apparatus head 1 of the FIG. 1, but this is not always advantageous since the apparatus head according to FIG. 1 is provided as a pure signal lamp, such that for this purpose no microswitch, no lift balancing part as well as no catch provision are required. Advantageously, a further electrical component device can be employed for a further function in the pressure tight chamber 62. It can also be advantageous to feed in the input voltage right away at the right voltage level of 18 volts such that the transformer in the pressure resistant space 48 can be eliminated. The free space resulting therefrom can at any rate be advantageously used for other parts such as for example electronic components (control element, relays, microprocessors and the like). This opens further advantageous application possibilities for the surveillance signal apparatus according to the present invention.

The embodiment illustrated in FIG. 3 is provided with conductor clamps 67 at the case 30' in contrast to the case 30 of the FIG. 2. Conductor parts 68 embedded into the cast resin belong to the conductor clamps 67. Thus here no hose line is provided but the case 30 can be connected to current buses and connectors or the like.

The invention signal apparatus 31 in addition is provided with an apparatus head 1' according to the embodiment illustrated in FIG. 3. The apparatus head 1' can be formed as an explosion proof illuminating key or as a switching unit or as an illuminating switch attachment. For this purpose, the lamp case 21, wherein the illuminating element 16 is disposed, is constructed somewhat differently. In addition, the lens 15' is surrounded by a rubberlike jacket and is disposed at a pressure sensitive key 70, which can be axially shifted in the direction against the casing 30' in the apparatus head 1'. A pressure shell 71 is coordinated to the pressure sensitive key 70 in the insertion body 3. This pressure shell 71 is provided with a helical spring 72 and upon actuation of the pressure sensitive key 70 the helical spring 72 acts against the pressure piece 40 surrounding the tube socket 32, by way of which the switching lift is transmitted via the catch provision 54, the lift balancing part 55 and the ram pin 59 to the microswitch or microswitches 63. Accordingly, this embodiment realizes a pressure sensitive switch signal apparatus, which is provided with a pressure sensitive key 70 for the displaying of an illuminating element 16 in the pressure sensitive key 70, where the feed part to the apparatus head 1' and this head even to the full extent are self safe protected against explosion such that no additional safety provisions are required. In concrete terms,the apparatus head 1' together with the illuminating element 16 and the pressure switch 70 is formed as an explosion proof switch illuminating unit, which already independent of the present invention disclosures and considered by itself provides the particular advantage that a switch or, respectively, an illuminating unit are integrated to a single building unit, which is protected against explosion. Such an explosion protected switch illuminating unit is so far unknown.

In order to avoid an impermissibly high excess temperature at the outside of the casing 30, 30' it may be advantageous to provide a temperature fuse or temperature security provision in the pressure resistant encapsulated space. This temperature fuse assures that a maximum outside temperature of 80 degrees Celsius is not surpassed under any circumstances.

A further important feature of the invention comprises that different color or different kind illuminating displays can be simply and without safety provisions exchanged such that an optimum function display can be achieved at any time corresponding to the requirements of that moment.

It will be understood that each of the elements described above, or two or more together, may also find a useful application in other types of surveillance system configurations and signal processing procedures differing from the types described above.

While the invention has been illustrated and described as embodied in the context of a surveillance signal system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

We claim:

1. A surveillance apparatus comprising electrical terminal connectors;

a casing providing an explosion-proof space having attached the electrical terminal connectors;

an apparatus head disengageable attached to the casing;

a voltage limiter disposed in the casing;

a current limiter disposed in the casing;

a feed part;

a signalling part disposed in the apparatus head and supplied with electrical power from the terminals of the apparatus head, where the voltage limiter and the current limiter are electrically predisposed to the signalling part via the feed part and where the apparatus head with the signalling part and the feed part from the output of the voltage limiter and of the current limiter are provided as an explosion-proof self-safety unit; and a printed circuit board disposed in the explosion-proof encapsulated space of the casing;

an electrical fuse disposed on the printed circuit board; connections provided between the feed part of the explosion-proof self safety unit and the printed circuit board in the explosion-proof space of the casing.

2. The surveillance apparatus according to claim 1 wherein a Zener diode is disposed in the explosion-proof encapsulated space of the casing, electrically predisposed to the signal part and operates as the voltage limiter;

an electrical resistance disposed in the explosion-proof encapsulated space of the casing, electrically predisposed to the signal part and operating as the electronic current limiter.

3. The surveillance apparatus according to claim 2 further comprising a rectifier electrically predisposed to the signalling part and disposed in the explosion-proof encapsulated space of the casing; and a transformer electrically predisposed to the voltage limiter and to the current limiter and disposed in the explosion-proof encapsulated space of the casing.

4. The surveillance apparatus according to claim 3 further comprising a cast resin surrounding the explosion-proof space of the casing containing at least the voltage limiter and the current limiter and wherein the voltage limiter, the current limiter and the transformer are embedded into the cast resin and are surrounded by an elastic wall region of the cast resin.

5. The surveillance apparatus according to claim 4 further comprising conductor terminals with conductor parts enclosed in the cast resin and disposed in the casing.

6. The surveillance apparatus according to claim 4 further comprising an electrical conduit with at least one wire disposed at a bottom side of the casing and enclosed in cast resin.

7. The surveillance apparatus according to claim 4 further comprising a tube socket provided for the feed part of the explosion-proof self safety unit in the casing, which surrounds electrical contact springs; and a contact bolt protruding from the apparatus head containing the signalling part to be supported in the tube socket.

8. The surveillance apparatus according to claim 7 further comprising a front flange at the tube socket of the feed part contacting an inner face of the case above the explosion-proof encapsulated space;

a closure cap cover blocking the tube socket at the front face disposed toward the explosion-proof encapsulated space of the casing; and a recess at the closure cap cover of the tube socket for receiving a front end of the contact bolt.

9. The surveillance apparatus according to claim 7 further comprising contact connections of the contact springs led into the region of the cast resin at the front side of the tube socket in the region of the closure cover cap, where the contact springs are inclined directed inwardly in the direction of the closure cover starting from an inner face of the tube socket of the feed part.

10. The surveillance apparatus according to claim 7 where base webs of the contact springs of the feed part are overlapped by wall parts of the tube socket and where an entering inclination is provided in an end region of the tube socket toward the apparatus head.

11. The surveillance apparatus according to claim 7 further comprising a compression spring acting in longitudinal direction of the tube socket, where the tube socket of the feed part is in the area of the compression spring, where one end of the compression spring is supported at the end of the casing and where the other end of the compression spring is supported at a pressure piece, which is supported guided at the casing and against the force of the compression spring.

12. The surveillance apparatus according to claim 11 further comprising an explosion-proof encapsulated chamber disposed in the casing;

a microswitch disposed in the explosion-proof encapsulated chamber next to the explosion-proof encapsulated space with the voltage limiter and the current limiter, which can be actuated via the pressure piece.

13. The surveillance apparatus according to claim 11 further comprising a lift balancing part disposed between the pressure piece and a microswitch, which is provided with a pot bolt with a balancing spring matchingly disposed inside the pot bolt;

a ram pin disposed between a base wall of the pot bolt and the microswitch in the chamber of the casing, which ram pin is axially movable in an explosion-proof slot feed-through in the wall the casing;

a catch provision coordinated to the pressure piece with two switch arresting positions;

a support frame of about hood shape for the casing, which support frame overlaps the pressure piece and the lift balancing part and the catch provision.

14. The surveillance apparatus according to claim 11 further comprising an axial conductor of the contact bolt of the feed part disposed in an insulating shell and at which one contact spring of the tube socket is disposed;

an outer shell conductor disposed at the insulating shell at which another contact spring rests;

a collar;

a lamp case containing the contact bolt of the apparatus head with the collar; and connecting conductors led from the collar and from the axial conductor to the signal part formed as an illuminating element.

15. The surveillance apparatus according to claim 14 further comprising a reflector having the illuminating element and both disposed in an illuminating case and embedded in a light permeable cast part.

16. The surveillance apparatus according to claim 14 further comprising a colored lens covering the illuminating element of the apparatus head; and a translucent cover hood mounted to the apparatus head over the illuminating element and the lens.

17. The surveillance apparatus according to claim 14 further comprising a light-emitting diode chip a ceramic carrier having bonded the light-emitting diode chip as a CERLED;

a support plate and at least two electronic illuminating parts forming a CERLED illuminating unit.

18. The surveillance apparatus according to claim 17 further comprising an insertion body screwed tightly with an attachment nut disposed at a threaded part at the inside of a wall;

a shell like front ring surrounding a lens, which is on the outside screwed onto a thread of the insertion body running through a hole through the wall of a switch cabinet.

19. The surveillance apparatus according to claim 14 further comprising a pressure key at the apparatus head with the illuminating element as an explosion protected switch illumination unit where an outer lens of the illuminating element is disposed in the pressure key repositionable axially in the apparatus head against the casing;

a rotary shell coordinated to the pressure key and axially movable against the force of a helical spring in the insertion body, which rotary shell acts against the pressure piece surrounding the tube socket.

* * * * *